US012253274B2

(12) United States Patent
Jones et al.

(10) Patent No.: US 12,253,274 B2
(45) Date of Patent: Mar. 18, 2025

(54) ANALOG HVAC CONTROLLER INCLUDING DIAL FOR SETTING TEMPERATURE SET POINTS

(71) Applicant: RESIDEO LLC, Golden Valley, MN (US)

(72) Inventors: Christopher R. Jones, Minneapolis, MN (US); Jaymeson Tucker, Minneapolis, MN (US); Michael Crites, Minneapolis, MN (US); Christopher Heintzelman, Plymouth, MN (US)

(73) Assignee: RESIDEO LLC, Golden Valley, MN (US)

( * ) Notice: Subject to any disclaimer, the term of this patent is extended or adjusted under 35 U.S.C. 154(b) by 201 days.

(21) Appl. No.: 17/756,595

(22) PCT Filed: Dec. 4, 2020

(86) PCT No.: PCT/US2020/063275

§ 371 (c)(1),
(2) Date: May 27, 2022

(87) PCT Pub. No.: WO2021/113614

PCT Pub. Date: Jun. 10, 2021

(65) Prior Publication Data

US 2023/0003406 A1 Jan. 5, 2023

Related U.S. Application Data

(60) Provisional application No. 62/943,734, filed on Dec. 4, 2019.

(51) Int. Cl.
*F24F 11/523* (2018.01)
*F24F 11/63* (2018.01)

(52) U.S. Cl.
CPC ..... *F24F 11/523* (2018.01); *F24F 11/63* (2018.01)

(58) Field of Classification Search
CPC ..... F24F 11/52; F24F 11/523; F24F 11/63; F24F 11/65
See application file for complete search history.

(56) References Cited

U.S. PATENT DOCUMENTS 5,931,378 A 8/1999 Schramm
6,726,112 B1 4/2004 Ho
(Continued)

FOREIGN PATENT DOCUMENTS

DE 29505606 U1 2/1996
DE 19958845 A1 6/2001
(Continued)

OTHER PUBLICATIONS

U.S. Appl. No. 17/756,589, filed Dec. 4, 2020, naming inventors Romero et al.

*Primary Examiner* — Henry T Crenshaw
(74) *Attorney, Agent, or Firm* — Greenberg Traurig, LLP; Ryan D. Sharp; David J. Dykeman

(57) ABSTRACT

In some examples, a device controls a heating, ventilation, and air conditioning (HVAC) system within a building. The device includes an analog display including a set of markers. Additionally, the devices includes processing circuitry configured to determine whether one or both of a cooling set point mode and a heating set point mode is activated and cause a set point to change from a first set point value to a second set point value in response to receiving a first rotation input to a dial. Additionally, the processing circuitry is configured to control a set of LEDs to transition from illuminating a first marker of the set of markers to illuminating a second marker of the set of markers, wherein the
(Continued)

first marker corresponds to the first set point value and the second marker corresponds to the second set point value.

20 Claims, 8 Drawing Sheets

(56) References Cited

U.S. PATENT DOCUMENTS

| | | | | |
|---|---|---|---|---|
| 2013/0345883 | A1 | 12/2013 | Sloo et al. | |
| 2014/0319232 | A1 | 10/2014 | Gourlay et al. | |
| 2015/0308705 | A1 | 10/2015 | Sloo et al. | |
| 2016/0146645 | A1 | 5/2016 | Kielb et al. | |
| 2018/0286297 | A1* | 10/2018 | Ong | G09G 3/36 |
| 2019/0093914 | A1* | 3/2019 | Ristimäki | F24F 11/523 |
| 2020/0166228 | A1* | 5/2020 | Gillette | F24F 11/80 |
| 2020/0224901 | A1* | 7/2020 | Spors | G05D 23/1902 |

FOREIGN PATENT DOCUMENTS

| | | | |
|---|---|---|---|
| DE | 102012200785 | A1 | 7/2013 |
| JP | 2009302004 | A | 12/2009 |
| WO | 2017035227 | A1 | 3/2017 |
| WO | 2017210517 | A2 | 12/2017 |

* cited by examiner

ANALOG HVAC CONTROLLER INCLUDING DIAL FOR SETTING TEMPERATURE SET POINTS

This application is a national stage entry of WO International Patent Application No. PCT/US2020/063275, filed 4 Dec. 2020, which claims the benefit of US Provisional Patent Application No. 62/943,734, filed 4 Dec. 2019, the entire content of each being incorporated herein by reference.

TECHNICAL FIELD

The disclosure relates to heating, ventilation, and air condition (HVAC) systems and thermostats for buildings.

BACKGROUND

A heating, ventilation, and air conditioning (HVAC) controller can control a variety of devices such as a furnace, a heat pump including a geothermal heat pump, a boiler, air conditioning unit, forced air circulation, and other similar equipment to control the internal climate conditions of a building. In some examples, a thermostat can control different devices depending on the outside temperature, temperature inside the building, the time of day, and other factors. Environmental control systems may also include evaporative cooling systems, also referred to as "swamp coolers" in this disclosure, as well as other systems such as window mounted heat exchangers and two-part heat exchangers, which may be used for heating or cooling building spaces. Two-part heat exchangers may include an inside heat exchanger and an outside heat exchanger connected by piping. To simplify the explanation, an environmental control system will be referred to as an HVAC system, unless otherwise noted.

SUMMARY

In general, this disclosure describes a heating, ventilation, and air conditioning (HVAC) controller including an analog display which can show one or more temperature set points for an area, a current temperature of the area, and one or more other parameters. In some examples, the analog display includes a set of markers and a pointer connected to an electric motor. The electric motor may set a position of the pointer to indicate, or "point," at a marker corresponding to a current temperature of the area. Additionally, the HVAC controller may control a set of light-emitting diodes (LEDs) to illuminate one or markers of the set of markers in order to identify one or more temperature set points. In this way, the HVAC controller may indicate, on the analog display, the current temperature of the area and one or more temperature set points for the area such that any differences between the current temperature and the one or more temperature set points is visible on the analog display. The HVAC controller may control, based on the one or more temperature set points, an HVAC system in order to regulate the temperature within the area.

In some examples, a device controls a heating, ventilation, and air conditioning (HVAC) system within a building. The device includes an analog display including a set of markers. Additionally, the devices includes processing circuitry configured to determine whether one or both of a cooling set point mode and a heating set point mode is activated and cause, in response to determining whether one or both of the cooling set point mode and the heating set point mode is activated, a set point to change from a first set point value to a second set point value in response to receiving a first rotation input to a dial. Additionally, the processing circuitry is configured to control a set of LEDs to transition from illuminating a first marker of the set of markers to illuminating a second marker of the set of markers, wherein the first marker corresponds to the first set point value and the second marker corresponds to the second set point value.

In some examples, a method includes determining, by processing circuitry of a device for controlling a heating, ventilation, and air conditioning (HVAC) system within a building, whether one or both of a cooling set point mode and a heating set point mode is activated and causing, by the processing circuitry in response to determining whether one or both of the cooling set point mode and the heating set point mode is activated, a set point to change from a first set point value to a second set point value in response to receiving a first rotation input to a dial. Additionally, the method includes controlling, by the processing circuitry, a set of LEDs to transition from illuminating a first marker of a set of markers to illuminating a second marker of the set of markers, wherein the first marker corresponds to the first set point value and the second marker corresponds to the second set point value, and wherein the device includes an analog display including the set of markers.

In some examples, a device controls a heating, ventilation, and air conditioning (HVAC) system within a building. The device includes a dial, an analog display including a set of markers, and processing circuitry. The processing circuitry is configured to determine whether one or both of a cooling set point mode and a heating set point mode is activated and cause, in response to determining whether one or both of the cooling set point mode and the heating set point mode is activated, a set point to change from a first set point value to a second set point value in response to receiving a first rotation input to the dial. Additionally, the processing circuitry is configured to control a set of LEDs to transition from illuminating a first marker of the set of markers to illuminating a second marker of the set of markers, wherein the first marker corresponds to the first set point value and the second marker corresponds to the second set point value.

The summary is intended to provide an overview of the subject matter described in this disclosure. It is not intended to provide an exclusive or exhaustive explanation of the systems, device, and methods described in detail within the accompanying drawings and description below. Further details of one or more examples of this disclosure are set forth in the accompanying drawings and in the description below. Other features, objects, and advantages will be apparent from the description and drawings, and from the claims.

DETAILED DESCRIPTION

Figure 1:
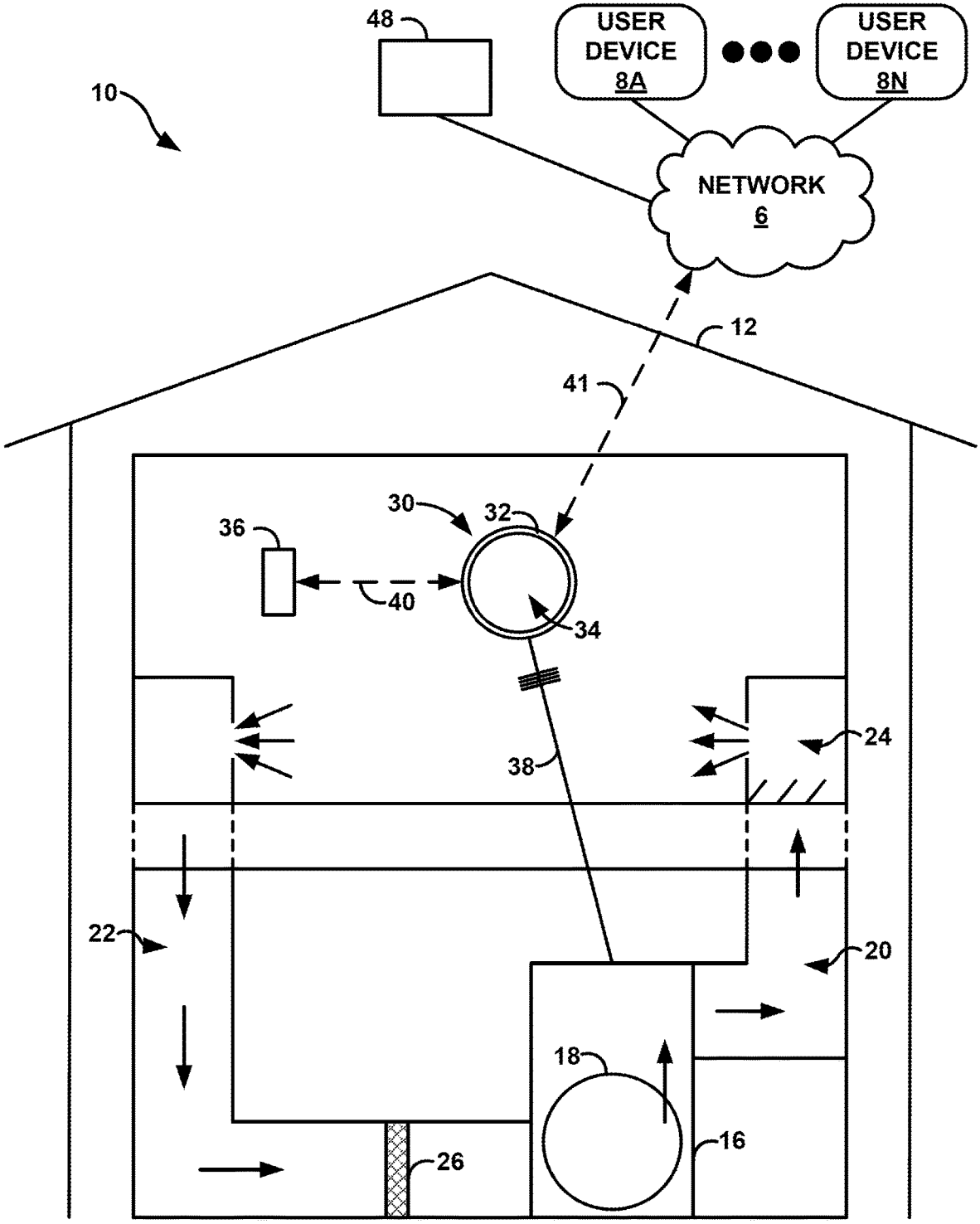
FIG. 1 is a block diagram illustrating an example heating, ventilation, and air conditioning (HVAC) system in a building, in accordance with one or more techniques described herein.

FIG. 1 is a block diagram illustrating an example heating, ventilation, and air conditioning (HVAC) system 10 in a building 12, in accordance with one or more techniques described herein. HVAC system 10 includes HVAC component(s) 16, a supply air duct 20, a return air duct 22 (collectively, "ducts 20, 22"), dampers 24, and air filters 26. Additionally, HVAC system 10 includes an HVAC controller 30 configured to control HVAC component(s) 16 to regulate one or more parameters within building 12. HVAC controller 30 may include a dial 32 and an analog display 34.

HVAC system 10 may include one or more devices for regulating an environment within building 12. For example, HVAC controller 30 may be configured to control the comfort level (e.g., temperature and/or humidity) in building 12 by activating and deactivating HVAC component(s) 16 in a controlled manner. HVAC controller 30 may be configured to control HVAC component(s) 16 via a wired or wireless communication link 38. In some examples, a wired communication link 38 may connect HVAC component(s) 16 and HVAC controller 30. HVAC controller 30 may be a thermostat, such as, for example, a wall mountable thermostat. In some examples, HVAC controller 30 may be programmable to allow for user-defined temperature set points to control the temperature of building 12. Based on sensed temperature of building 12, HVAC controller 30 may turn on HVAC component(s) 16 or turn off HVAC component(s) 16 in order to reach the user-defined temperature set point. Although this disclosure describes HVAC controller 30 (and controllers shown in other figures) as controlling HVAC component(s) 16, external computing device 36 may also be configured to perform these functions. The techniques of this disclosure will primarily be described using examples related to temperature, but the systems, devices, and methods described herein may also be used in conjunction with other sensed properties, such as humidity or air quality. In some examples, HVAC controller 30 may be configured to control all of the critical networks of a building, including a security system.

HVAC component(s) 16 may provide heated air (and/or cooled air) via the ductwork throughout the building 12. As illustrated, HVAC component(s) 16 may be in fluid communication with one or more spaces, rooms, and/or zones in building 12 via ducts 20, 22, but this is not required. In operation, when HVAC controller 30 outputs a heat call signal to HVAC component(s) 16, HVAC component(s) 16 (e.g., a forced warm air furnace) may turn on (begin operating or activate) to supply heated air to one or more spaces within building 12 via supply air ducts 20. HVAC component(s) 16, which include an air movement device 18 (e.g., a blower or a fan), can force the heated air through supply air duct 20. In this example, cooler air from each space returns to HVAC component(s) 16 (e.g. forced warm air furnace) for heating via return air ducts 22. Similarly, when a cool call signal is provided by HVAC controller 30, a cooling device (e.g., an air conditioning (AC) unit) of HVAC component(s) 16 may turn on to supply cooled air to one or more spaces within building 12 via supply air ducts 20. Air movement device 18 may force the cooled air through supply air duct 20. In this example, warmer air from each space of building 12 may return to HVAC component(s) 16 for cooling via return air ducts 22.

In some examples, HVAC component(s) 16 may include any one or combination of a fan, a blower, a furnace, a heat pump, an electric heat pump, a geothermal heat pump, an electric heating unit, an AC unit, a humidifier, a dehumidifier, an air exchanger, an air cleaner, a damper, a valve, and a fan, however this is not required. HVAC component(s) 16 may include any device or group of devices which contributes to regulating the environment within building 12 based on signals received from HVAC controller 30 or contributes to regulating the environment within building 12 independently from HVAC controller 30.

Ducts 20, 22 may include one or more dampers 24 to regulate the flow of air, but this is not required. For example, one or more dampers 24 may be coupled to HVAC controller 30 and can be coordinated with the operation of HVAC component(s) 16. HVAC controller 30 may actuate dampers 24 to an open position, a closed position, and/or a partially open position to modulate the flow of air from the one or more HVAC components to an appropriate room and/or space in building 12. Dampers 24 may be particularly useful in zoned HVAC systems, and may be used to control which space(s) in building 12 receive conditioned air and/or receives how much conditioned air from HVAC component(s) 16.

In many instances, air filters 26 may be used to remove dust and other pollutants from the air inside building 12. In the example shown in FIG. 1, air filters 26 is installed in return air duct 22 and may filter the air prior to the air entering HVAC component(s) 16, but it is contemplated that any other suitable location for air filters 26 may be used. The presence of air filters 26 may not only improve the indoor air quality but may also protect the HVAC component(s) 16 from dust and other particulate matter that would otherwise be permitted to enter HVAC component(s) 16.

HVAC controller 30 may include any suitable arrangement of hardware, software, firmware, or any combination thereof. For example, HVAC controller 30 may include processing circuitry comprising microprocessors, digital signal processors (DSPs), application specific integrated circuits (ASICs), field-programmable gate arrays (FPGAs), or equivalent discrete or integrated logic circuitry, or a combination of any of the foregoing devices or circuitry. Accordingly, the processing circuitry may include any suitable structure, whether in hardware, software, firmware, or any combination thereof, to perform the functions ascribed herein to HVAC controller 30.

Although not shown in FIG. 1, HVAC controller 30 may include a memory configured to store information within HVAC controller 30 during operation. The memory may include a computer-readable storage medium or computer-readable storage device. In some examples, the memory includes one or more of a short-term memory or a long-term memory. The memory may include, for example, random access memories (RAM), dynamic random access memories (DRAM), static random access memories (SRAM), magnetic discs, optical discs, flash memories, or forms of electrically programmable memories (EPROM) or electrically erasable and programmable memories (EEPROM). In some examples, the memory is used to store program instructions for execution by the processing circuitry of HVAC controller 30. In some examples, the memory of HVAC controller 30 may be able to store data to and read data from memory included in external computing device 36 and/or memory included in external database 48. The memory may be used for storing network settings such as an Internet Protocol (IP) address and/or a Media Access Control (MAC) address of HVAC controller 30, external computing device 36, and/or a router.

In some examples, HVAC controller 30 may include a set of wire terminals which make up a terminal block (e.g., a wall plate or a terminal plate) for receiving a set of control wires for one or more HVAC component(s) 16 of HVAC system 10. The memory of HVAC controller 30 may store one or more wiring configurations for HVAC component(s) 16, allowing HVAC controller 30 to determine which of HVAC component(s) 16 are connected to HVAC controller 30. The memory of HVAC controller 30 may also store settings for HVAC system 10 which correspond to the one or more wiring configurations for HVAC component(s) 16. For example, if HVAC controller 30 is wired to an AC unit of HVAC component(s) 16, HVAC controller 30 may determine one or more settings for controlling the AC unit to turn on and turn off.

In some examples, the memory of HVAC controller 30 may store program instructions, which may include one or more program modules, which are executable by HVAC controller 30. When executed by HVAC controller 30, such program instructions may cause HVAC controller 30 to provide the functionality ascribed to it herein. The program instructions may be embodied in software, firmware, and/or RAMware.

In some examples, HVAC controller 30 may include a dial 32 which is located at an outer circumference of HVAC controller 30. HVAC controller 30 may be fixed to a wall or another surface such that dial 32 may be rotated relative to one or more other components (e.g., analog display 34) of HVAC controller 30. Dial 32 may represent a user interface such that processing circuitry of HVAC controller 30 may receive, dial 32 and/or dial circuitry electrically connected to dial 32, information indicative of a user input. In some examples, the user input may represent a user selection of a set point parameter value (e.g., a set point temperature), a user selection of information to be displayed by HVAC controller 30, or a user selection of another setting. In some examples, dial 32 may smoothly rotate with respect to analog display 34. In some examples, dial 32 may rotate with one or more steps such that as dial 32 rotates, dial 32 "snaps" into position after every interval of rotational distance. In some examples, dial 32 may smoothly rotate with respect to analog display 34 and HVAC controller 30 may output an audio signal (e.g., a clicking noise) for every interval of rotational position (e.g., every one degree) in which dial 32 rotates.

In some examples, dial 32 does not move inwards in response to a force applied to dial 32. For example, dial 32 may rotate about a center axis which passes through a center of dial 32 without moving along the center axis in response to one or more forces applied to dial 32. When HVAC controller 30 is mounted on a vertical surface such as a wall, HVAC controller 30 may prevent dial 32 from depressing inwards towards the vertical surface while allowing the dial 32 to rotate.

In some examples, dial 32 may include a set of light-emitting diodes (LEDs) configured to illuminate a portion or a whole of dial 32, but this is not required. The processing circuitry of HVAC controller 30 may selectively illuminate one or more LEDs of the set of LEDs in order to indicate a set point temperature or convey other information. In some examples, the set of LEDs included in dial 32 may illuminate dial 32 to indicate that HVAC system 10 is in a heating or indicate that HVAC system 10 is cooling. For example, when HVAC system 10 is heating (e.g., HVAC controller 30 is outputting one or more instructions for HVAC component (s) 16 to increase a temperature within building 12), the LEDs of dial 32 cause dial 32 to illuminate at a first color. When HVAC system 10 is cooling (e.g., HVAC controller 30 is outputting one or more instructions for HVAC component (s) 16 to decrease a temperature within building 12), the LEDs of dial 32 cause dial 32 to illuminate at a second color. In this way, the LEDs of dial 32 may indicate whether HVAC system 10 is operating in heating or cooling.

Analog display 34 may include information relating to one or more aspects of an area in which HVAC controller 30 is located (e.g., a room in which HVAC controller 30 is located, a building in which HVAC controller 30 is located, an area outside of a building in which HVAC controller 30 is located, or any combination thereof). Analog display 34 may be round in shape and analog display 34 may be located an area within a circumference of dial 32 such that edges of dial 32 are visible around an outer circumference of analog display 34. At least part of dial 32 and analog display 34 may represent an outer surface of HVAC controller 30. In some cases, HVAC controller 30 may receive user input to one or both of dial 32 and analog display 34.

A user may interact with HVAC controller 30 through a mobile phone, a tablet, a computer, or another device. For example, user devices 8A-8N (collectively, "user devices 8") may communicate with HVAC controller 30 via network 6. HVAC controller 30 may, in some examples, be configured to communicate directly with network 6 without communicating with network 6 via a gateway device (e.g., a Wi-Fi router) within building 12. In some examples, HVAC controller 30 may receive instructions from one or more of user devices 8. The instructions may include, for example, a request to change a set point temperature for an area within building 12. HVAC controller 30 may change the set point temperature in response to receiving the instruction. In turn, HVAC controller 30 may control HVAC component(s) 16 to control the temperature within building 12 to reach the new set point.

In some examples, responsive to detecting a rotation of dial 32 while HVAC controller 30 is in the idle state, HVAC controller 30 transitions out of the idle state to a set point state. HVAC controller 30 may change a temperature set point for an area within building 12 in response to detecting the rotation of dial 32. In other words, HVAC controller 30 may determine that a rotation of dial 32 while HVAC controller 30 is in the idle state represents a user request to change a temperature set point. In transitioning out of the idle state, the processing circuitry of HVAC controller 30 may display the temperature set point for the area within building 12 on analog display 34. Additionally, HVAC controller 30 may display the temperature set point changing as dial 32 rotates. For example, the analog display 34 may show the temperature setpoint cycle through a range of degrees, where each change from one degree to another degree is reflected on analog display 34. In some examples, HVAC controller 30 may emit a noise each time the temperature set point changes from one degree value to another degree value. The noise may represent a clicking noise, a tapping noise, or another type of noise.

In some examples, HVAC controller 30 may control HVAC components 16 based on more than one set points. For example, HVAC controller 30 may determine whether one or both of a first set point mode and a second set point mode is activated. In some examples, the first set point mode represents a cooling temperature set point mode and the second set point mode represents a heating set point mode. In the cooling set point mode, the HVAC controller 30 may be configured to change a cooling set point, and in the heating set point mode, the HVAC controller 30 may be configured to change a heating set point. A cooling set point may represent a temperature set point for controlling HVAC components 16 to decrease or maintain a temperature within building 12 as compared with a temperature outside of building 12. A heating set point may represent a temperature set point for controlling HVAC components 16 to increase or maintain a temperature within building 12 as compared with a temperature outside of building 12.

In some examples, HVAC controller 30 is configured to receive user input representing an instruction to enter the first set point mode. In some examples, HVAC controller 30 is configured to receive user input representing an instruction to enter the second set point mode. HVAC controller 30 may enter the second set point mode in response to receiving user input representing a request to enter the second set point mode. For example, HVAC controller 30 may deactivate the first set point mode and activate the second set point mode in response to receiving information indicative of a user input to a mode button representing a request to enter the second set point mode. Alternatively, HVAC controller 30 may enter the first set point mode in response to receiving user input representing a request to enter the first set point mode. For example, HVAC controller 30 may deactivate the second set point mode in response to receiving information indicative of a user input to a mode button representing a request to enter the first set point mode.

HVAC controller 30 is configured to cause, based on the first set point mode being activated, the first set point of the device to change in response to receiving a rotation input to dial 32. Additionally, HVAC controller 30 is configured to cause, based on the second set point mode being activated, the second set point of the device to change in response to receiving a rotation input to dial 32. In this way, HVAC controller 30 may control one or both of the first set point and the second set point to change based on a rotation input to dial 32.

HVAC controller 30 may include a communication device (not illustrated in FIG. 1) to allow HVAC controller 30 to communicate via a wired or wireless connection 40 to external computing device 36. The communication device may include a Bluetooth transmitter and receiver, a Wi-Fi transmitter and receiver, a Zigbee transceiver, a near-field communication transceiver, or other circuitry configured to allow HVAC controller 30 to communicate with external computing device 36. In some examples, the communication device may allow HVAC controller 30 to exchange data with external computing device 36. Examples of exchanged data include a desired temperature for building 12, HVAC component(s) 16 connected to HVAC controller 30, error codes, geographic location, estimated energy usage and cost, and/or other operating parameters or system performance characteristics for HVAC system 10.

HVAC controller 30 may communicate via wired or wireless connection 40 with external computing device 36. External computing device 36 may be, include, or otherwise be used in combination with a mobile phone, smartphone, tablet computer, personal computer, desktop computer, personal digital assistant, router, modem, remote server or cloud computing device, and/or related device allowing HVAC controller 30 to communicate over a communication network such as, for example, the Internet or other wired or wireless connection. Communicating via the wired or wireless connection 40 may allow HVAC controller 30 to be configured, controlled, or otherwise exchange data with external computing device 36. In some examples, HVAC controller 30 communicating via wired or wireless connection 40 may allow a user to set up HVAC controller 30 when first installing the controller in building 12. In some examples, HVAC controller 30 and external computing device 36 communicate through a wireless network device such as a router or a switch. In other examples, HVAC controller 30 and external computing device 36 communicate through a wired connection such as an ethernet port, USB connection, or other wired communication network.

HVAC controller 30 may, via the communication device, communicate via a wired or wireless connection 41 with external database 48. In some examples, wired or wireless connection 41 enables HVAC controller 30 to communicate with external database 48 via a wireless connection which includes a network device such as a router, ethernet port, or switch. HVAC controller 30 and external database 48 may also communicate through a wired connection such as an ethernet port, USB connection, or other wired communication network. Communicating via the wired or wireless connection 41 may allow HVAC controller 30 to exchange data with external database 48. As such, external database 48 may be at a location outside of building 12. In some examples, external database 48 may be, include, or otherwise be used in combination with a remote server, cloud computing device, or network of controllers configured to communicate with each other. For example, HVAC controller 30 may receive data from HVAC controllers in nearby buildings through the internet or other city- or wide-area network. HVAC controller 30 may include the onboard database because it is unable to communicate via the communication device.

In some examples, external database 48 may be, or otherwise be included in, or accessed via, external computing device 36 (e.g., smartphone, mobile phone, tablet computer, personal computer, etc.). For example, HVAC controller 30 may communicate via a Wi-Fi network connection with a smartphone device to exchange data with external database 48. By communicating via wired or wireless connection 41, HVAC controller 30 may exchange data with external database 48.

In some examples, HVAC controller 30 may display a setpoint as a bright white light at moving around a perimeter of HVAC controller 30. As dial 32 rotates, the light may move with dial 32 to show a selected setpoint. If the setpoint is changed via a mobile application on one or more of user devices 8, the light may move on HVAC controller 30 to show the selected setpoint. An application of one of user devices 8 may enable a user to view one or more aspects of HVAC controller 30.

In some examples, if a Buoy water valve is installed, HVAC controller 30 may receive details on water usage and leak status. In some examples, if a security system is installed, HVAC controller 30 may control the security system.

Figure 2:
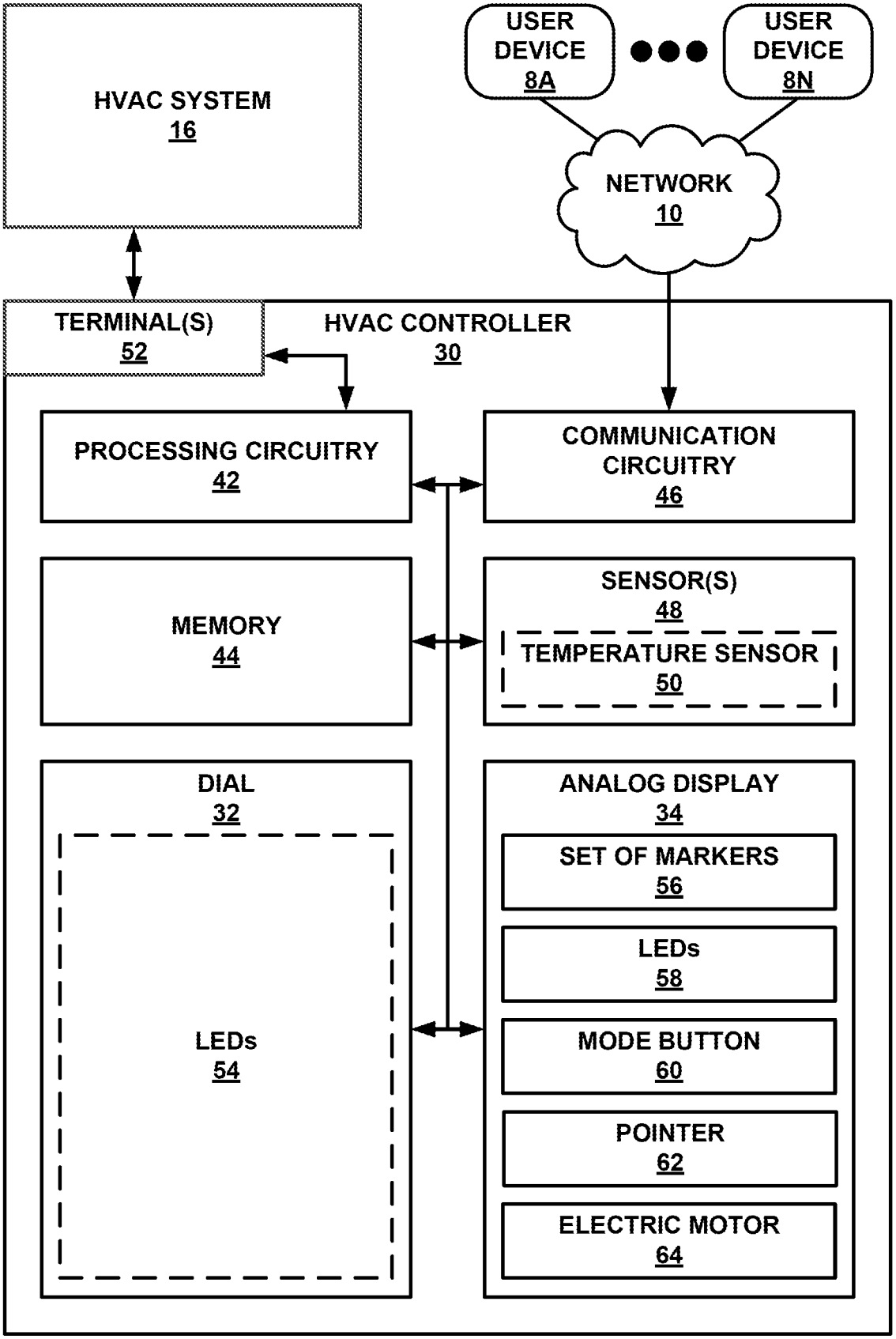
FIG. 2 is a block diagram illustrating an example HVAC controller including a dial and an analog display, in accordance with one or more techniques described herein.

FIG. 2 is a block diagram illustrating an example HVAC controller 30 including a dial 32 and an analog display 34, in accordance with one or more techniques described herein. As seen in FIG. 2, HVAC controller 30 includes processing circuitry 42, memory 44, communication circuitry 46, sensor(s) 48, and terminal(s) 52. Sensor(s) 48 may, in some examples, include a temperature sensor 50. In some examples, dial 32 includes LEDs 54. Analog display 34 includes markers 56, LEDs 58, mode button 60, pointer 62, and electric motor 64. In HVAC controller 30 may be configured to communicate with HVAC system 10 via terminal(s) 52 and/or communicate with user devices 8A-8N (collectively, "user devices 8") via network 6.

HVAC controller 30 may be configured to control HVAC system 10 in order to regulate one or more parameters of a space (e.g., a building, one or more rooms within a building, a large vehicle, or a vessel). In some examples, HVAC controller 30 regulates a temperature within the space. HVAC controller 30 may regulate the temperature of the space by using HVAC system 10 to decrease a temperature of the space if the current temperature of the space is greater than a first set point temperature and/or increase a temperature of the space using HVAC system 10 if the current temperature of the space is less than a second set point temperature. In some examples, the first set point temperature (e.g., a cooling set point temperature) is less than the second set point temperature (e.g., a heating set point temperature). In some examples, the first set point temperature is equal to the second set point temperature.

Processing circuitry 42 may include fixed function circuitry and/or programmable processing circuitry. Processing circuitry 42 may include any one or more of a microprocessor, a controller, a DSP, an ASIC, an FPGA, or equivalent discrete or analog logic circuitry. In some examples, processing circuitry 42 may include multiple components, such as any combination of one or more microprocessors, one or more controllers, one or more DSPs, one or more ASICs, or one or more FPGAs, as well as other discrete or integrated logic circuitry. The functions attributed to processing circuitry 42 herein may be embodied as software, firmware, hardware or any combination thereof.

In some examples, memory 44 includes computer-readable instructions that, when executed by processing circuitry 42, cause HVAC controller 30 and processing circuitry 42 to perform various functions attributed to HVAC controller 30 and processing circuitry 42 herein. Memory 44 may include any volatile, non-volatile, magnetic, optical, or electrical media, such as, for example, RAM, DRAM, SRAM, magnetic discs, optical discs, flash memories, or forms of EPROM or EEPROM. In some examples, the memory is used to store program instructions for execution by the processing circuitry of HVAC controller 30.

Communication circuitry 46 may include any suitable hardware, firmware, software or any combination thereof for communicating with another device, such as user devices 8 or other devices. Under the control of processing circuitry 42, communication circuitry 46 may receive downlink telemetry from, as well as send uplink telemetry to, one of user devices 8 or another device with the aid of an internal or external antenna. Communication circuitry 46 may include a Bluetooth transmitter and receiver, a Wi-Fi transmitter and receiver, a Zigbee transceiver, a near-field communication transceiver, or other circuitry configured to allow HVAC controller 30 to communicate with one or more remote devices such as user devices 8. In some examples, communication circuitry 46 may allow HVAC controller 30 to exchange data with external computing device 123 of FIG. 1. Examples of exchanged data include a desired temperature for the space, one or more control parameters for HVAC system 10, error codes, geographic location, estimated energy usage and cost, and/or other operating parameters or system performance characteristics for HVAC system 10.

In some examples, HVAC controller 30 includes one or more sensor(s) 48 including temperature sensor 50. In some examples, temperature sensor 50 is located within a housing of HVAC controller 30. In some examples, temperature sensor 50 is located remotely from HVAC controller 30 and may communicate with HVAC controller 30 via communication circuitry 46. For example, temperature sensor 50 may be located in the same room or the same area as HVAC controller 30 while being separate from HVAC controller 30 such that heat generated from components of HVAC controller 30 does not affect a temperature signal generated by temperature sensor 50. It may be beneficial for temperature sensor 50 to be located separately from HVAC controller 30 in order to obtain an accurate temperature reading. In some examples where temperature sensor 50 is located within the housing of HVAC controller 30, HVAC controller 30 may prevent components from affecting a temperature signal generated by temperature sensor 50. In some examples, at least a portion of the housing of HVAC controller 30 may include stainless steel and the housing may be coated with a material which hides fingerprints. In some examples, the term "housing" may be used herein to describe an outer surface of HVAC controller 30, including on outer surface of dial 32, an outer surface of analog display 34, and an outer face of HVAC controller 30 which is fixed to a wall or another surface.

In some examples, a housing of HVAC controller 30 may be substantially cylindrical in shape, and dial 32 may represent a ring-shaped piece that is located at an outer circumference of HVAC controller 30. In some examples, HVAC controller 30 includes a first face configured to be mounted on a plate which is fixed to a wall or another surface, a second face including a display, and a third face representing a side of HVAC controller 30, the third face extending around a circumference of HVAC controller 30. Dial 32 may include the third face of HVAC controller 30. In some examples, dial 32 is configured to rotate with respect to one or more other components of HVAC controller 30. For example, dial 32 is configured to rotate with respect to analog display 34. In some examples, dial 32 is configured to rotate in response to a user input. Dial 32 may be electrically connected to dial circuitry (not illustrated in FIG. 2) which may generate an electrical signal indicative of one or more rotational parameters (e.g., a rotational position, a rotational velocity, and/or a rotational acceleration) of dial 32. The dial circuitry may output the electrical signal indicative of the one or more rotational parameters to processing circuitry 42. In some examples, the dial circuitry is part of processing circuitry 42.

Processing circuitry 42 may be configured to set and/or change one or more temperature set points corresponding to the space in which HVAC controller 30 regulates temperature. For example, a first set point temperature may represent a cooling set point temperature and a second set point temperature may represent a heating set point temperature. In some examples, if HVAC controller 30 is cooling and the current temperature is greater than the cooling set point temperature, processing circuitry 42 may control HVAC system 10 to regulate the temperature in the space to approach the cooling set point temperature over a period of time based on the current temperature and the cooling set point temperature. In some examples, if HVAC controller 30 heating and the current temperature is less than the heating set point temperature, processing circuitry 42 may control HVAC system 10 to regulate the temperature in the space to approach the heating set point temperature over a period of time based on the current temperature and the heating set point temperature.

In some example, processing circuitry 42 is configured to receive an instruction to change and/or set one or more temperature set points of HVAC controller 30 from dial circuitry electrically connected to dial 32, where the instruction is indicative of a user selection of one or more temperature set points using dial 32. For example, in response to a first rotation of dial 32, processing circuitry 42 may set the cooling temperature set point value to a first temperature value if a cooling set point mode of HVAC controller 30 is activated. In some examples, HVAC controller 30 includes a mode button (not illustrated in FIG. 2) electrically connected to processing circuitry 42 which is configured to generate a signal based on a user request to switch a set point mode between the cooling set point mode and a heating set point mode. In response to a second rotation of dial 32, processing circuitry 42 may set the heating temperature set point value to a second temperature value if a heating set point mode of HVAC controller 30 is activated. In some examples, processing circuitry 42 is configured to receive an instruction to change and/or set one or more temperature set points of HVAC controller 30 from one or more of user devices 8 via network 6. Processing circuitry 42 may change the one or more temperature set points based on such an instruction.

In some examples, dial 32 includes LEDs 54. LEDs 54 may be, in some cases, a part of dial 32. In some examples, each LED of LEDs 54 may be configured to output an optical signal. LEDs 54 may be arranged in an array around the circumference of dial 32 such that the optical signal output by each LED of LEDs 54 is emitted outwards from a face of HVAC controller 30 which includes analog display 34. In some examples, processing circuitry 42 is configured to cause at least some of LEDs 54 to output an optical signal of a first color when HVAC controller 30 is in a heating set point mode and the current temperature is lower than the heating set point temperature. In some examples, processing circuitry 42 is configured to cause at least some of LEDs 54 to output an optical signal of a second color when HVAC controller 30 is in a cooling set point mode and the current temperature is greater than the cooling set point temperature. In some examples, the first color is red and the second color is blue, but this is not required. Each of the first color and the second color may represent any visible wavelength of light.

In some examples, analog display 34 includes LEDs 58. In some examples, processing circuitry 42 is configured to selectively activate LEDs 58 in order to selectively illuminate one or more of the markers 56. In some examples, processing circuitry 42 selectively illuminates one or more of the set of markers in order to indicate one or more temperature set points (e.g., the cooling set point and/or the heating set point). In some examples, HVAC controller 30 includes LEDs 58 instead of LEDs 54. In some examples, HVAC controller 30 includes both of LEDs 54 and LEDs 58. LEDs 58 may be located behind a surface of analog display 34 which includes the markers 56. In some examples, LEDs 58 may emit optical signals which cause one or more of markers 56 to light up.

In some examples, markers 56 may include a set of temperature markers. The set of temperature markers may represent a range of temperatures. In some examples, the range of temperatures includes a lower-bound temperature and an upper-bound temperature. In some examples, the lower-bound temperature is 50 degrees Fahrenheit (° F.) and the upper-bound temperature is 90° F., but this is not required. The range of temperatures may include any range of temperatures. In some examples, each temperature marker of the set of temperature markers is in the shape of a dash, or a line. The set of temperature markers may be arranged in a semi-circular array the set of temperature markers are equally spaced apart. In some examples, markers 56 may include a set of numeric temperature indicators. Each numeric temperature indicator of the set of numeric temperature indicators may indicate a temperature associated with a respective temperature marker of the set of temperature markers.

In some examples, LEDs 58 may illuminate one or more of the set of temperature markers in order to indicate one or more temperature set points. For example, processing circuitry 42 may cause LEDs 58 to illuminate a first temperature marker of the set of temperature markers to indicate a first temperature set point and illuminate a second temperature marker of the set of temperature markers to indicate a second temperature set point. That is, the first temperature marker may by associated with a first temperature value corresponding to the first temperature set point, and the second temperature marker may by associated with a second temperature value corresponding to the second temperature set point. In some examples, processing circuitry 42 may cause LEDs 58 to change the temperature marker of the set of temperature markers that is illuminated to indicate the first temperature set point. In some examples, processing circuitry 42 may cause LEDs 58 to change the temperature marker of the set of temperature markers that is illuminated to indicate the second temperature set point.

In some examples, HVAC controller 30 may receive one or more inputs to mode button 60. For example, HVAC controller 30 may operate according to a first temperature set point mode and a second temperature set point mode. In some examples, when HVAC controller 30 receives an input to mode button 60, processing circuitry 42 may transition from operating according to the first temperature set point mode to operating according to the second temperature set point mode, or processing circuitry 42 may transition from operating according to the second temperature set point mode to operating according to the first temperature set point mode. When HVAC controller 30 is operating according to the first temperature set point mode, processing circuitry 42 may change a first temperature set point in response to receiving a user input to the dial 32, and when HVAC controller 30 is operating according to the second temperature set point mode, processing circuitry 42 may change a second temperature set point in response to receiving a user input to the dial 32.

For example, processing circuitry 42 may determine whether one or both of a cooling set point mode and a heating set point mode is activated. Processing circuitry 42 may receive a first rotation input to dial 32. When processing circuitry 42 determines that the cooling set point mode is activated, processing circuitry 42 may cause a cooling set point to change from a first cooling set point value to a second cooling set point value in response to receiving a first rotation input to dial 32. Processing circuitry may control LEDs 58 to transition from illuminating a first marker of the set of markers 56 to illuminating a second marker the set of markers 56, wherein the first marker corresponds to the first cooling set point value and the second marker corresponds to the second cooling set point value. When the first cooling set point value is greater than a heating set point value, and when the second cooling set point value is greater than or equal to the heating set point value, processing circuitry 42 may cause the cooling set point to change from the first cooling set point value to the second cooling set point value without changing the heating set point value in response to receiving the first rotation input to dial 32.

Alternatively, when processing circuitry 42 determines that the heating set point mode is activated, processing circuitry 42 may cause a heating set point to change from a first heating set point value to a second heating set point value in response to receiving a first rotation input to dial 32. Processing circuitry may control LEDs 58 to transition from illuminating a first marker of the set of markers 56 to illuminating a second marker the set of markers 56, wherein the first marker corresponds to the first heating set point value and the second marker corresponds to the second heating set point value. When the first heating set point value is less than a cooling set point value, and when the second heating set point value is less than or equal to the cooling set point value, processing circuitry 42 may cause the heating set point to change from the first heating set point value to the second heating set point value without changing the cooling set point in response to receiving the first rotation input to dial 32.

In some examples, it may be beneficial for HVAC controller 30 to always maintain the heating set point to be less than or equal to the cooling set point. For example, if the HVAC controller 30 sets the heating set point to be greater than the cooling set point, the HVAC controller 30 may simultaneously attempt to heat building 12 and cool building 12 when the current temperature is between the heating set point and the cooling set point. Performing only one of heating and cooling is more energy efficient that performing both of heating and cooling at the same time. Consequently, it is beneficial for HVAC controller 30 to maintain the heating set point to be less than or equal to the cooling set point. Consequently, when processing circuitry 42 decreases the cooling set point to be lower than an initial heating set point value, processing circuitry 42 may also decrease the heating set point in unison with the cooling set point. Additionally, or alternatively, when processing circuitry 42 increases the heating set point to be greater than an initial cooling set point value, processing circuitry 42 may also increase the cooling set point in unison with the heating set point.

HVAC controller 30 may control LEDs 58 to indicate a change in the heating set point and/or a change in the cooling set point as the changes are happening. In one example, HVAC controller 30 may decrease the cooling set point by two degrees in response to receiving a rotation input to dial 32, and HVAC controller 30 may control LEDs 58 to show the cooling set point "move" across the set of markers 56. For example, as dial 32 is rotating, HVAC controller 30 may cause LEDs 58 to transition from illuminating a first marker of the set of markers 56 to illuminating a second marker of the set of markers 56, and HVAC controller 30 may cause LEDs 58 to transition from illuminating the second marker of the set of markers 56 to illuminating a third marker of the set of markers 56. The second marker is one degree lower than the first marker, and the third marker is one degree lower than the second marker. As such, a user may view the transition of the set point by observing the set of markers 56. In some examples, LEDs 58 cause an illuminated marker to blink when a set point is changing, but this is not required.

Pointer 62 may extend along a radius of analog display 34 and pointer 62 may be configured to rotate about a center point of analog display 34 such that pointer 62 "points" at one or more markers of the set of markers 56. In some examples, electric motor 64 may receive an electric signal from processing circuitry 42 which causes electric motor 64 to place pointer 62 in order to indicate a current temperature of the space (e.g., an area within building 12) in which HVAC controller 30 is performing temperature regulation using HVAC components 16. In some examples, processing circuitry 42 receives a temperature signal from temperature sensor 50, the temperature signal indicating the current temperature of the space in real-time or near real-time. Processing circuitry 42 may cause electric motor 64 to place (e.g., rotate) the pointer 62 based on the temperature signal in order to indicate the current temperature by pointing pointer 62 at a marker of the set of markers 56 which corresponds to the current temperature. In this way, pointer 62 may point at a marker of the set of markers 56 to indicate the current temperature of space, and LEDs 58 may illuminate one or more markers of the set of markers 56 to indicate one or more respective temperature set points for controlling HVAC components 16 to regulate the temperature within the space.

Figure 3A:
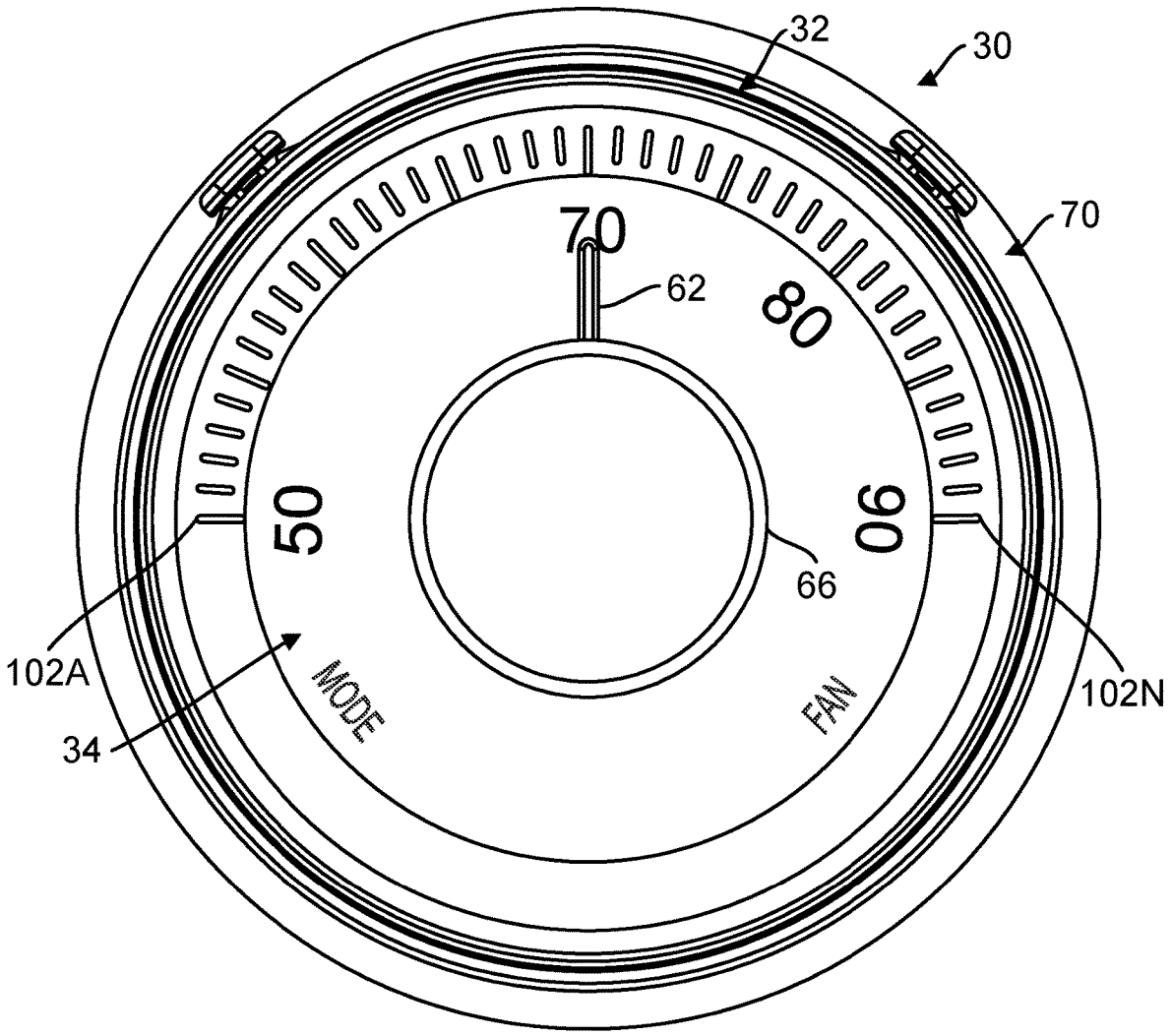
FIG. 3A is a conceptual diagram illustrating a front view of the HVAC controller of FIGS. 1-2, in accordance with one or more techniques described herein.

FIG. 3A is a conceptual diagram illustrating a front view of HVAC controller 30, in accordance with one or more techniques described herein. As seen in FIG. 3A, HVAC controller 30 includes dial 32, analog display 34, and wall plate 70. Analog display 34 includes pointer 62, center plate 66, and a set of markers 102A-102N (collectively, "set of markers 102").

In some examples, HVAC controller 30 includes one or more LEDs (e.g., LEDs 58 of FIG. 2) which may illuminate any one or combination of the set of markers 102 in order to indicate one or more parameter values of the range of parameter values displayed on the surface of analog display 34. Dial 32 may represent a rotatable dial which is located at an outer circumference of analog display 34. For example, dial 32 may rotate about a center of HVAC controller 30 while a surface of analog display 34 remains fixed in place. That is, when dial 32 rotates about the center of HVAC controller 30, the surface of analog display 34 and the wall plate 70 do not rotate. Dial 32 is configured to rotate clockwise and rotate counterclockwise. HVAC controller 30 may control one or more temperature set points based on rotation inputs to dial 32. For example, HVAC controller 30 may increase one or more temperature set points responsive to receiving a clockwise rotation input and HVAC controller 30 may decrease one or more temperature set points responsive to receiving a counterclockwise rotation input. HVAC controller 30 may control one or more other parameters based on rotation inputs to dial 32. For example, HVAC controller 30 may control one or more modes of operation, control one or more humidity set points, or control one or more other set points responsive to rotation inputs to dial 32.

In some examples, the LEDs of HVAC controller 30 may illuminate one or more markers of the set of markers 102 in order to indicate one or more temperature set points. For example, HVAC controller 30 may illuminate a first marker of the set of markers 102 to indicate a first temperature set point and HVAC controller 30 may illuminate a second marker of the set of markers 102 to indicate a second temperature set point. That is, the first marker may correspond to a first temperature value and the second marker may correspond to a second temperature value, where the first temperature set point is the first temperature value and the second temperature set point is the second temperature value. In some examples, the first temperature set point and the second temperature set point are at the same temperature value, and HVAC controller illuminates one marker of the set of markers 102 which corresponds to the temperature value of the first temperature set point and the second temperature set point. In some examples, HVAC controller 30 may indicate more than two temperature set points or indicate less than two temperature set points by illuminating one or more of markers 102.

One or more LEDs may project a ring of light onto a face of analog display 34 from wall plate 70. For example, at least some of the one or more LEDs may project light perpendicular to the face of analog display 34, and a reflective component beneath center plate 66 may reflect the light radially from underneath center plate 66 onto the surface of analog display 34. In this way, the light projected onto the surface of analog display 34 may be in the shape of a halo. As seen in FIG. 3A, the first marker 102A of the set of markers 102 corresponds to a first parameter value of a range of parameter values and the last marker 102N of the set of markers 102 corresponds to a last parameter value of the range of parameter values. In this example, the range of parameter values represents a range of temperatures extending from 50° F. to 90° F. However, this range is not meant to be limiting. Although in the example of FIG. 3A only a four parameter values (e.g., 50, 70, 80, and 90) are displayed, other parameter values are evident based on the relative placement of the parameter values on analog display 34. For example, the group of markers of the set of markers corresponding to a sub-range of parameter values from 50° F. to 90° F. includes 11 markers. In this way, each marker corresponds to one parameter value and the marker preceding the last marker 102N corresponds to 89° F.

An electric motor (not illustrated in FIG. 3A) may be located underneath and/or proximate to center plate 66. The electric motor may be configured to move (e.g., rotate) pointer 62 such that pointer 62 indicates a parameter value of the range of parameter values shown on the face of analog display 34. In some examples, the rotation of pointer 62 is confined to an area of analog display 34 which includes the set of markers 102. For example, the electric motor may be configured to rotate pointer 62 within a 180 degree range from first marker 102A to second marker 102. In some examples, physical barriers (not illustrated in FIG. 3A) prevent the electric motor from rotating pointer 62 beyond first marker 102A or prevent the electric motor from rotating pointer 62 beyond the last marker 102N. In the example of FIG. 3A, pointer 62 indicates a marker of the set of markers 102 which corresponds to 70° F. In some examples, HVAC controller 30 controls pointer 62 to indicate a current temperature in a space which HVAC controller 30 regulates. As such, in the example of FIG. 3A, pointer 62 indicates that the current temperature in the space is 70°. HVAC controller 30 may determine a temperature of the space based on a signal received from a temperature sensor (e.g., temperature sensor 50 of FIG. 2). HVAC controller 30 may control the electric motor in order to rotate pointer 62 such that pointer 62 indicates the current temperature.

Figure 3B:
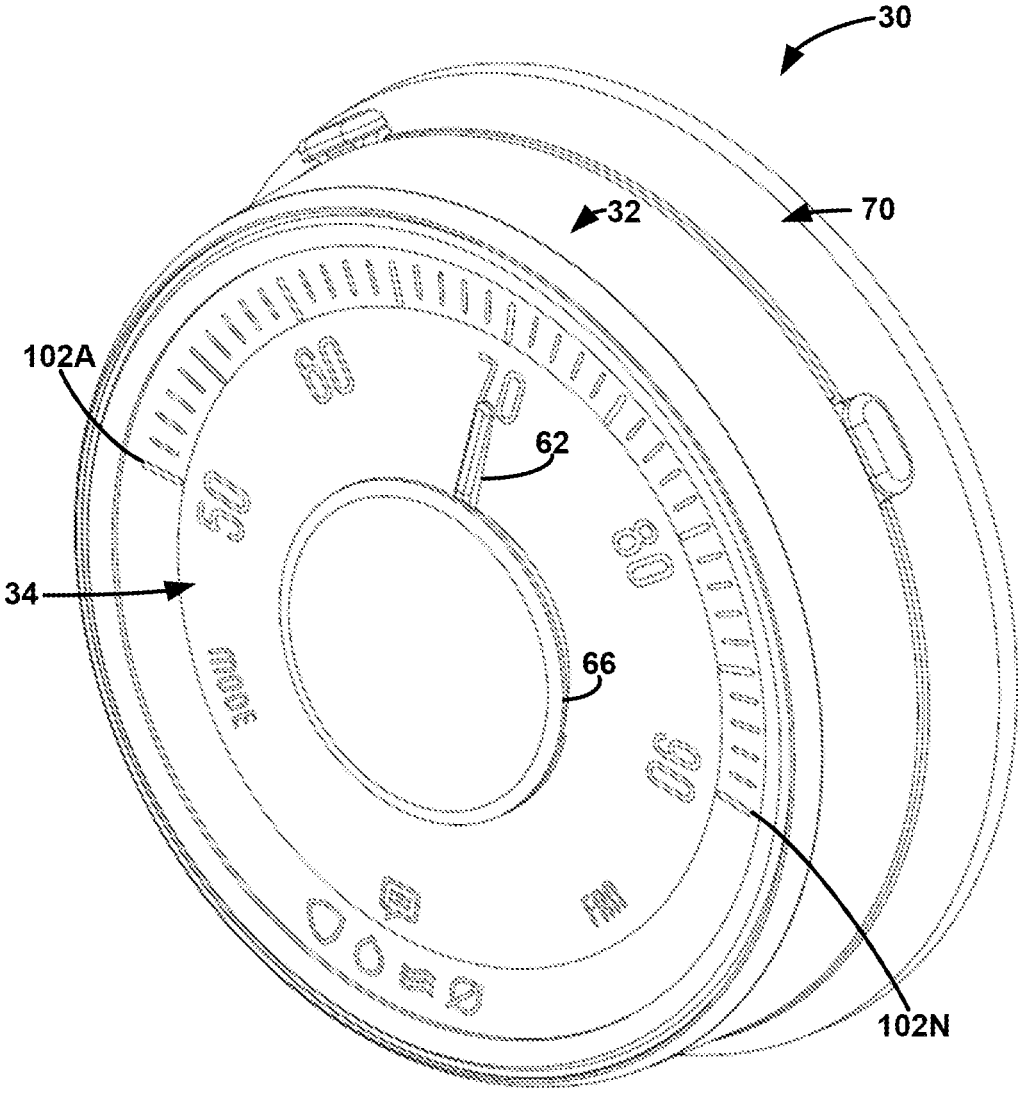
FIG. 3B is a conceptual diagram illustrating an example perspective view of the HVAC controller of FIGS. 1-2, in accordance with one or more techniques described herein.

FIG. 3B is a conceptual diagram illustrating an example perspective view of HVAC controller 30, in accordance with one or more techniques described herein. As seen in FIG. 3B, dial 32 is a round component which is located at an outer circumference of the analog display 34, which is also round. Wall plate 70 may be fixed to a wall or another surface. Analog display, dial 32, and other components of HVAC controller 30 may be fixed to wall plate 70 such that HVAC controller 30 is fixed to the wall or another surface. In some examples, wall plate 70 and analog display 34 are configured to remain fixed in one place, whereas dial 32 and pointer 62 are configured to rotate about a center of HVAC controller 30. At least a portion of controller 30 may be substantially cylindrical in shape, with a front face including analog display 34, a side face including dial 32 which is rotatable with respect to analog display 34, and a back face which is fixed to wall plate 70. The controller illustrated in FIGS. 3A-3B is one example of controller 30 of FIGS. 1-2, but controller 30 of FIGS. 3A-3B is not meant to be limited to the example of FIGS. 3A-3B. HVAC controller 30 may include other example controllers not illustrated in FIGS. 3A-3B.

Figure 4A:
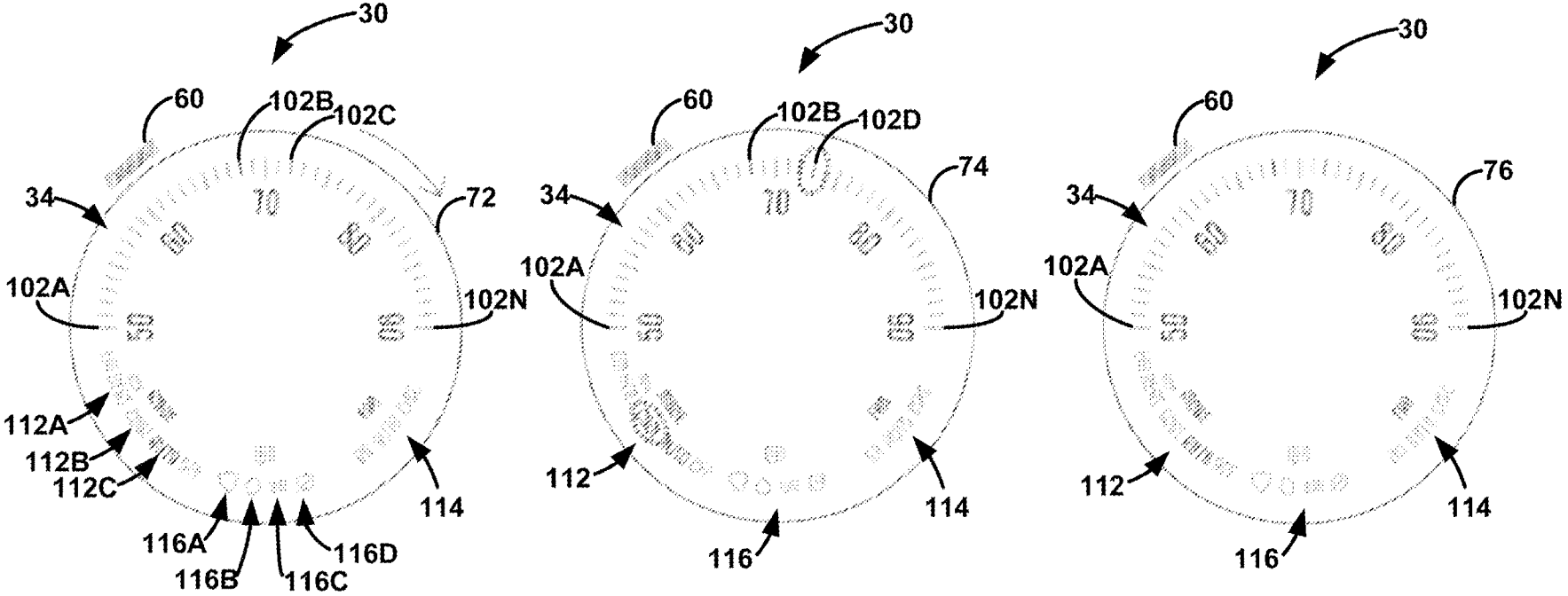
FIG. 4A is a conceptual diagram illustrating a first set of configurations of the analog display of FIGS. 1-3B, in accordance with one or more techniques described herein.

FIG. 4A is a conceptual diagram illustrating a first set of configurations of analog display 34, in accordance with one or more techniques described herein. Although configuration 72, configuration 74, and configuration 76 (collectively, "configurations 72, 74, 76") represent example configurations for analog display 34 of FIG. 2, other configurations are also within the scope of this disclosure. That is, markers and indicators which are illuminated in configurations 72, 74, 76 might not be illuminated in other possible configurations of analog display 34, and markers and indicators which are not illuminated in configurations 72, 74, 76 might be illuminated in other possible configurations of analog display 34.

As shown in the example of FIG. 4A, analog display 34 includes a set of markers 102A-102N (collectively, "set of markers 102"). The set of markers 102 represents a sequence of markers which begins with marker 102A and ends with marker 102N. The set of markers 102 corresponds to a range of temperatures that extends from a lower-bound temperature to an upper-bound temperature. In the example of FIG. 4A, the lower-bound temperature is 50 degrees Fahrenheit (° F.) and the upper-bound temperature is 90° F., meaning that marker 102A corresponds to the lower-bound temperature of 50° F. and marker 102N corresponds to the upper-bound temperature of 90° F. Each marker of the set of markers 102 corresponds to a temperature value within the range of temperatures. Although analog display 34 of FIG. 4A displays a temperature range from 50° F. to 90° F., the techniques of this disclosure are not meant to be limited to this range. The range of temperatures may include any valid range of temperatures. The set of markers 102 includes intermediate markers between marker 102A and marker 102N. The intermediate markers include marker 102B, marker 102C, and marker 102D. Markers 102B, 102C, and 102D are not consecutive. For instance, three markers are located between marker 102B and marker 102C. Markers 102B, 102C, and 102D are labeled in order to describe one or more techniques of this disclosure.

As shown in the example of FIG. 4A, markers 102 are arranged on the analog display 34 in a semi-circle pattern. Although not every marker is necessarily labeled with a numerical temperature value, each marker of markers 102 corresponds to a temperature value within the range of temperatures. For example, marker 102B corresponds to 68° F., marker 102C corresponds to 72° F., and marker 102C corresponds to 73° F.

Analog display 34 includes a set of mode indicators 112A-112C (collectively, "mode indicators 112"). The set of mode indicators may indicate which set point of a group of set points is to be updated based on user input to dial 32. Analog display 34 of FIG. 4A may be an example of the analog display 34 which is included by controller 30 of FIG. 2. Mode button 60 may be allow a user to toggle between modes of the set of mode indicators 112. The modes in the example of FIG. 4A include, a heating set point mode 112A (e.g., "HEAT" on analog display 34), a cooling set point mode 112B (e.g., "COOL" on analog display 34), and an automatic set point mode 112C (e.g., "AUTO" on analog display 34), but different, additional, or fewer modes may also be used. The selected or active mode may be illuminated or otherwise marked in a manner that is distinguishable from the unselected or inactive modes.

In some examples, controller 30 may include a fan button (i.e., "FAN" in FIG. 4A) which controls one or more fan settings given by fan setting indicators 114. In the example of FIG. 4A, the fan settings include ON, AUTO, and CIRC, but different, additional, or fewer settings may also be used. The selected or active setting may be illuminated or otherwise marked in a manner that is distinguishable from the unselected or inactive settings.

Controller 30 may include a set of warning indicators 116A-116D (collectively, "warning indicators 116") including a security warning indicator 116A, a water warning indicator 116B, an air quality warning indicator 116C, and an energy warning indicator 116D. A warning indicator of warning indicators 116 may be illuminated by one or more LEDs configured to illuminate an associated icon on analog display 34 in response to processing circuitry 42 receiving a warning signal from a system corresponding to the respective warning indicator. For example, if processing circuitry 42 determines that one or more irregularities exist in a security system, processing circuitry 42 may output a signal to illuminate security warning indicator 116A. The warning indicator may alert a user to a potential problem. In some instances, HVAC controller 30 may be in communication with other systems and devices, such that if the user sees the warning indicator on HVAC controller 30, then the user will know to obtain additional details regarding the warning via a different device, such as a smart phone or tablet or at the source of problem. Other types of indicators, in addition to or in lieu of warning indicators, may also be used.

Figure 4B:
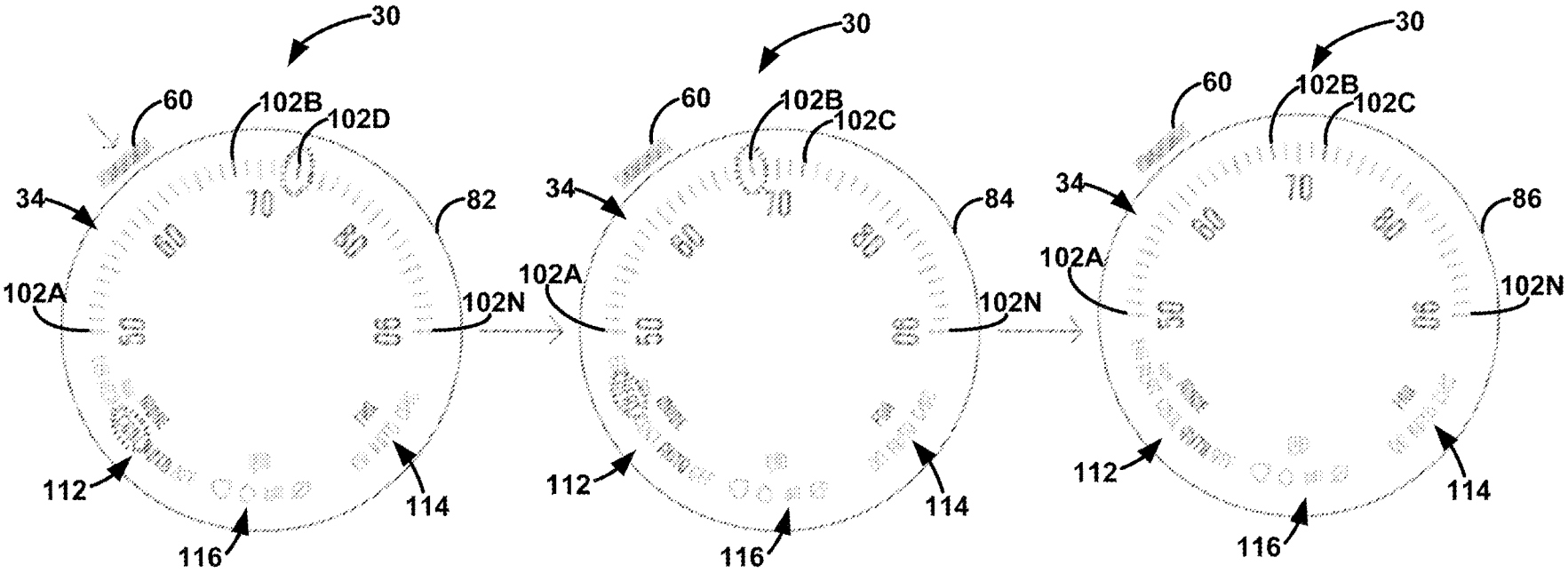
FIG. 4B is a conceptual diagram illustrating a second set of configurations of the analog display of FIGS. 1-3B, in accordance with one or more techniques described herein.
Figure 4C:
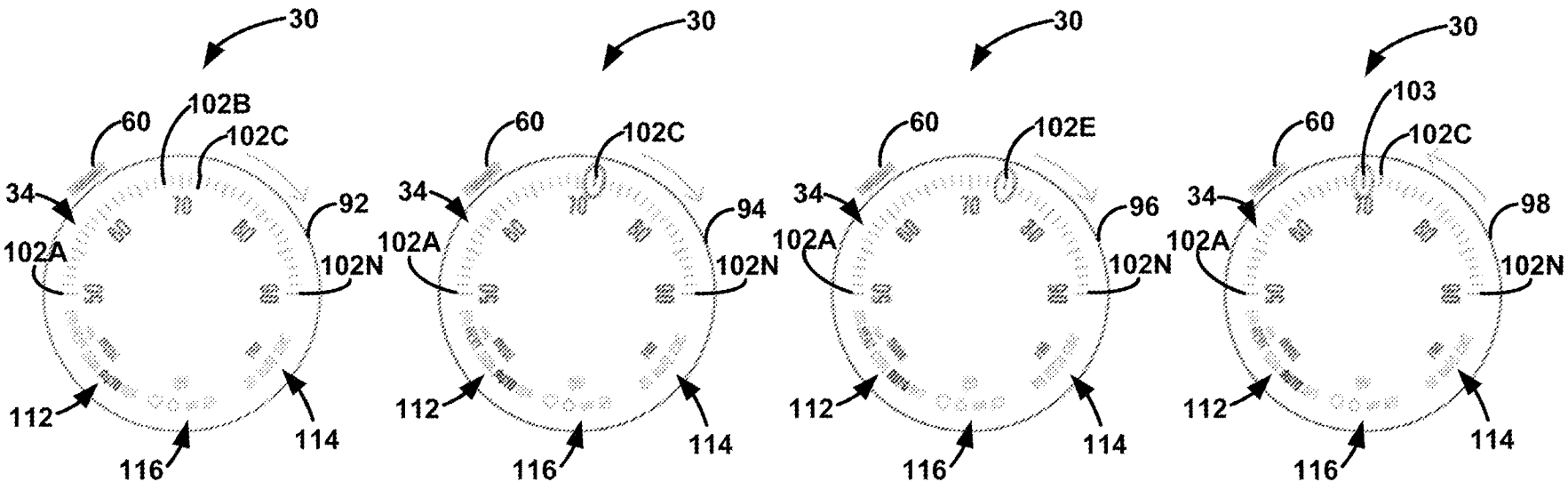
FIG. 4C is a conceptual diagram illustrating a third set of configurations of the analog display of FIGS. 1-3B, in accordance with one or more techniques described herein.

In some examples, the analog display 34, various configurations of which are shown in FIGS. 4A-4C, may be illuminated by one or more of a number of LEDs (e.g., LEDs 58 of FIG. 2), where the number of LEDs is within a range from 50 LEDs to 100 LEDs. In some examples, the number of LEDs is 67 LEDs. The LEDs may illuminate any one or more of markers 102, mode indicators 112, fan indicators 114, and warning indicators 116.

In some examples, HVAC controller 30 may receive a rotation input to dial 32. The rotation input may represent one or both of a clockwise rotation input or a counterclockwise rotation input. When a set point mode of HVAC controller 30 is activated, HVAC controller 30 may change one or more set point modes in response to receiving a rotation input to dial 32. Processing circuitry 42 may determine a set point mode that is activated. For example, HVAC controller 30 may include a heating set point mode, a cooling set point mode, and an automatic set point mode. When the heating set point mode is activated, processing circuitry 42 may change a heating set point in response to receiving a rotation input to dial 32. When the cooling set point mode is activated, processing circuitry 42 may change a cooling set point in response to receiving a rotation input to dial 32.

When the automatic set point mode is activated, processing circuitry 42 may change a most recently changed temperature set point in response to receiving a rotation input to dial 32. For example, if the cooling set point is the temperature set point that was most recently changed when HVAC controller 30 receives a rotation input to dial 32, processing circuitry 42 may change the cooling set point in response to receiving the rotation input. If the heating set point is the temperature set point that was most recently changed when HVAC controller 30 receives a rotation input to dial 32, processing circuitry 42 may change the heating set point in response to receiving the rotation input.

Configurations 72, 74, and 76 of analog display 34 may correspond to one technique of changing a set point of HVAC controller 30 in based on receiving a rotation input to dial 32. For example, in the first configuration 72 of analog display 34, marker 102B and marker 102C are illuminated. Marker 102B indicates a first temperature set point and marker 102C indicates a second temperature set point. Marker 102B corresponds to 68° F. As such, by illuminating marker 102B, HVAC controller 30 indicates that the first temperature set point is 68° F. Marker 102C corresponds to 72° F. By illuminating marker 102C, HVAC controller 30 indicates that the second temperature set point is 72° F. In configuration 72, mode indicator 112C is illuminated, indicating that the automatic set point mode is active. When the automatic set point mode is active, in response to a rotation of dial 32, HVAC controller 30 may update a temperature set point which was most recently changed in response to a rotation input to dial 32. Consequently, when HVAC controller 30 receives a clockwise rotation input to dial 32, HVAC controller 30 may update the temperature set point which was most recently changed and update a marker of markers 102 which is illuminated in order to reflect the change in the temperature set point.

The change in the temperature set point is shown in the transition from configuration 72 to configuration 74. For example, in configuration 72, marker 102C is illuminated, and in configuration 74, marker 102D is illuminated and marker 102C is not illuminated. In transitioning from illuminating marker 102C to illuminating marker 102D, HVAC controller 30 may indicate a change in the second temperature set point from 72° F. to 73° F. HVAC controller 30 may change the second temperature set point from 72° F. to 73° F. in response to receiving a clockwise rotation input to dial 32. In some examples, the first temperature set point is a heating set point and the second temperature set point is a cooling set point.

In the example of FIG. 4A, the automatic set point mode is active. As such, when dial 32 is rotated, HVAC controller 30 may automatically update the cooling set point rather than update the heating set point, since the cooling set point was more recently updated. As HVAC controller 30 is updating the cooling temperature set point from marker 102C to marker 102D, the "COOL" mode indicator may blink in tandem with the marker of the set of markers corresponding to the current cooling set point temperature. By causing the marker corresponding to the current cooling set point temperature to blink while HVAC controller 30 updates the cooling set point in response to a user input to dial 32, HVAC controller 30 may allow a user to differentiate between the cooling setpoint, which is being updated from marker 102C to marker 102D based on a rotation of dial 32, and the heating setpoint, which is not being updated based on a rotation of dial 32. In some examples, after a period of time following a rotation of dial 32, the "COOL" mode indicator and the marker corresponding to the cooling set point may stop blinking, as seen in configuration 76 of analog display 34. In some examples, the period of time represents a 3-second window of time.

FIG. 4B is a conceptual diagram illustrating a second set of configurations of analog display 34, in accordance with one or more techniques described herein. Although configuration 82, configuration 84, and configuration 86 (collectively, "configurations 82, 84, 86") represent example configurations for analog display 34 of FIG. 2, other configurations are also within the scope of this disclosure. That is, markers and indicators which are illuminated in configurations 82, 84, 86 might not be illuminated in other possible configurations of analog display 34, and markers and indicators which are not illuminated in configurations 82, 84, 86 might be illuminated in other possible configurations of analog display 34.

In configuration 82, the cooling set point of HVAC controller 30 might have been more recently updated than the heating set point of HVAC controller 30. As such, the "COOL" mode indicator of the set of mode indicators 112 and the marker corresponding to the cooling temperature set point (e.g., marker 102D) are configured to blink in tandem, thus informing a user that a rotation of dial 32 may cause the cooling temperature set point to change. In some examples, processing circuitry 42 may receive information indicative of a user input to mode button 60. In response to receiving the user input, processing circuitry may update the set point mode from a cooling set point mode to a heating set point mode. In turn, the "HEAT" mode indicator may start blinking, as seen in configuration 84 of analog display 34. After the set point mode is changed from the cooling set point mode to the heating set point mode, processing circuitry 42 may change the heating temperature set point based on a rotation of dial 32. After a period of time following the rotation of dial 32, analog display 34 may transition to sixth configuration 86, where the "AUTO" mode indicator is lit up, indicating a return to the automatic set point mode. If another rotation of dial 32 is detected, the heat set point may be updated since the heating set point mode is more recently used than the cooling set point mode.

Although HVAC controller 30 is configured to update one or both of the heating set point and the cooling set point based on rotation inputs to dial 32, HVAC controller 30 may, in some cases, update temperature set points based on other inputs. For example, controller 30 may update one or both of the cooling set point and the heating set point based on information received a user device of user devices 16 (e.g., user device 16A) of FIGS. 1-2. In some examples, user device 16A may represent a smart phone, a tablet, a desktop computer, or another device configured to execute an application for controlling one or more parameters of controller 30. As such, controller 30 may receive information indicative of a user selection of the heating set point and/or a user selection of the cooling set point, and HVAC controller 30 may control the heating set point and/or the cooling set point based on the user selection.

FIG. 4C is a conceptual diagram illustrating a third set of configurations of analog display 34, in accordance with one or more techniques described herein. Although configuration 92, configuration 94, configuration 96, and configuration 98 (collectively, "configurations 92, 94, 96, 98") represent example configurations for analog display 34 of FIG. 2, other configurations are also within the scope of this disclosure. That is, markers and indicators which are illuminated in configurations 92, 94, 96, 98 might not be illuminated in other possible configurations of analog display 34, and markers and indicators which are not illuminated in configurations 92, 94, 96, 98 might be illuminated in other possible configurations of analog display 34.

When the heating set point is initially lower than the cooling set point and HVAC controller 30 subsequently increases the heating set point from a first value to a second value that is greater than the cooling set point, HVAC controller 30 may also increase the cooling set point to the second value. As seen in configuration 92 of analog display 34, the heating set point is initially at marker 102B and the cooling set point is initially at marker 102C. HVAC controller 30 may receive a clockwise rotational input to dial 32. In response to the clockwise rotation, analog display 34 may transition from configuration 92 to configuration 94. At configuration 94, the heating set point may reach the temperature value of the cooling set point. As such, HVAC controller 30 illuminates marker 102C to indicate that both of the heating set point and the cooling set are at 72° F. Configuration 94 represents an intermediate configuration in a transition from configuration 92 to configuration 96. In response to the clockwise rotation, the HVAC controller 30 may increase the heating set point to 74° F., which is greater than the initial cooling set point of 72° F. When HVAC controller 30 increases the heating set point to 74° F., the HVAC controller 30 may also increase the cooling set point to 74° F. to match the heating set point. Marker 102E corresponds to 74° F. Consequently, in configuration 76, HVAC controller 30 illuminates marker 102E to indicate that both of the heating set point and the cooling set point are set to 74° F.

In some examples, HVAC controller 30 may receive a counterclockwise rotation input to dial 32. Since the heating set point is the most recently updated set point, HVAC controller 30 may decrease the heating set point in response to the counterclockwise rotation input. As seen in FIG. 4C, HVAC controller 30 may decrease the heating set point from 74° F. to 70° F., and transition analog display 34 from configuration 96 to configuration 98. Since the heating set point of 70° F. is lower than the initial cooling set point 72° F., HVAC controller 30 may decrease the cooling set point from 74° F. to the initial cooling set point of 72° F. when HVAC controller 30 decreases the heating set point from 74° F. to 70° F.

Figure 5:
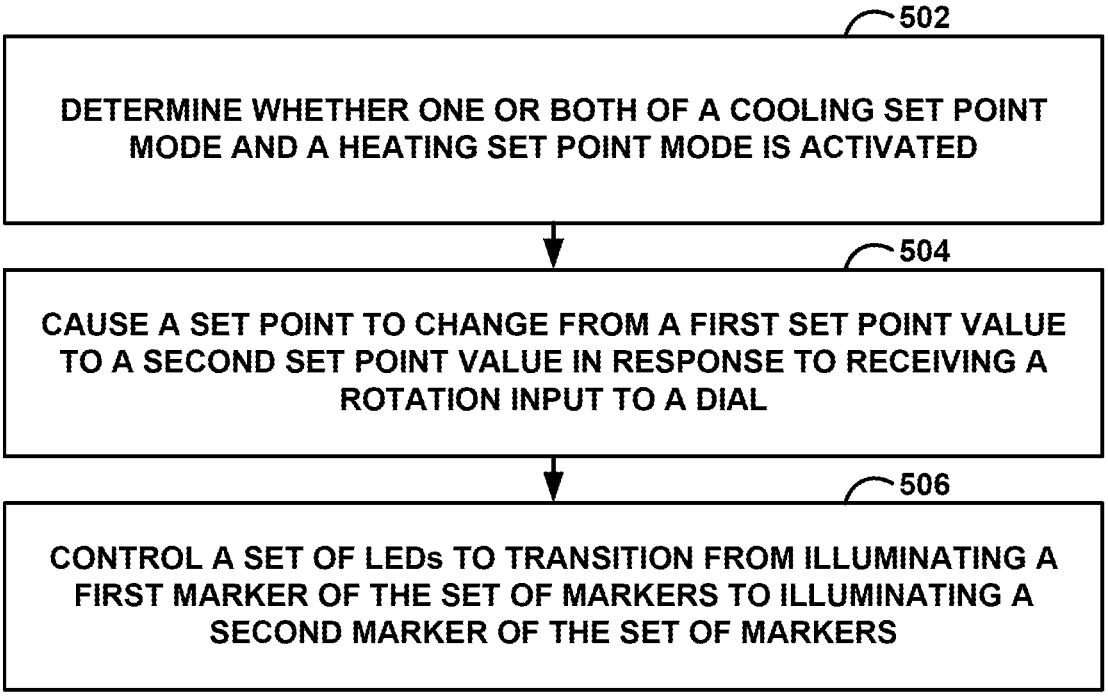
FIG. 5 is a flow diagram illustrating an example operation for changing one or more temperature set points of the HVAC controller of FIGS. 1-2, in accordance with one or more techniques described herein.

FIG. 5 is a flow diagram illustrating an example operation for changing one or more temperature set points of the HVAC controller 30 of FIGS. 1-2, in accordance with one or more techniques described herein. FIG. 5 is described with respect to HVAC controller 30 and HVAC component(s) 16 of FIGS. 1-2. However, the techniques of FIG. 5 may be performed by different components of HVAC controller 30 and HVAC component(s) 16 or by additional or alternative devices.

Processing circuitry 42 may be configured to determine whether one or both of a cooling set point mode and a heating set point mode is activated (502). The cooling set point mode may allow HVAC controller 30 to change a cooling set point and the heating set point mode may allow HVAC controller 30 to change a heating set point. Processing circuitry 42 may cause a set point to change from a first set point value to a second set point value in response to receiving a rotation input to dial 32 (504). For example, processing circuitry 42 may cause the cooling set point to change from a first cooling set point value to a second cooling set point value when the cooling set point mode is activated. Additionally, processing circuitry 42 may cause the heating set point to change from a first heating set point value to a second heating set point value when the cooling set point mode is activated.

Processing circuitry 42 may control LEDs 58 to transition from illuminating a first marker of the set of markers 56 to illuminating a second marker of the set of markers 56 (506). In some examples, the first marker corresponds to the first set point value and the second marker corresponds to the second set point value. For example, processing circuitry 42 may transition from illuminating a first marker to illuminating a second marker in order to indicate the change in the set point.

The following examples are example systems, devices, and methods described herein.

Example 1: A device for controlling a heating, ventilation, and air conditioning (HVAC) system within a building, the device comprising: an analog display including a set of markers; and processing circuitry configured to: determine whether one or both of a cooling set point mode and a heating set point mode is activated; cause, in response to determining whether one or both of the cooling set point mode and the heating set point mode is activated, a set point to change from a first set point value to a second set point value in response to receiving a first rotation input to a dial; and control a set of LEDs to transition from illuminating a first marker of the set of markers to illuminating a second marker of the set of markers, wherein the first marker corresponds to the first set point value and the second marker corresponds to the second set point value.

Example 2: The device of example 1, wherein the processing circuitry is configured to: determine that the cooling set point mode is activated; and cause, in response to determining that the cooling set point mode is activated, a cooling set point to change from a first cooling set point value to a second cooling set point value in response to receiving the first rotation input to the dial, wherein the first marker corresponds to the first cooling set point value and the second marker corresponds to the second cooling set point value.

Example 3: The device of example 2, wherein the first cooling set point value is greater than a heating set point value, wherein the second cooling set point value is greater than or equal to the heating set point value, and wherein the processing circuitry is configured to: cause the cooling set point to change from the first cooling set point value to the second cooling set point value without changing the heating set point value in response to receiving the first rotation input to the dial.

Example 4: The device of any of examples 1-3, wherein the processing circuitry is configured to: determine that the heating set point mode is activated; and cause, in response to determining that the heating set point mode is activated, a heating set point to change from a first heating set point value to a second heating set point value in response to receiving the first rotation input to the dial, wherein the first marker corresponds to the first heating set point value and the second marker corresponds to the second heating set point value.

Example 5: The device of example 4, wherein the first heating set point value is less than a cooling set point value, wherein the second heating set point value is less than or equal to the cooling set point value, and wherein the processing circuitry is configured to: cause the heating set point to change from the first heating set point value to the second heating set point value without changing the cooling set point value in response to receiving the first rotation input to the dial.

Example 6: The device of any of examples 4-5, wherein the first heating set point value is lower than a first cooling set point value, wherein the second heating set point value is greater than the first cooling set point value, and wherein the processing circuitry is configured to: cause the cooling set point to change from the first cooling set point value to a second cooling set point value in response to receiving the first rotation input to the dial, wherein the second cooling set point value is the same as the second heating set point value.

Example 7: The device of example 6, wherein the processing circuitry is configured to: receive a second rotation input to the dial; cause the heating set point to change from the second heating set point value to a third heating set point value in response to receiving the second rotation input to the dial, wherein the third heating set point value is lower than the first cooling set point value; and cause the cooling set point value to change from the second cooling set point value to the first cooling set point value in response to receiving the second rotation input to the dial.

Example 8: The device of any of examples 1-7, wherein the processing circuitry is configured to, if the cooling set point mode is activated: deactivate the cooling set point mode in response to receiving information indicative of a user input to a mode button; and activate the heating set point mode in response to receiving the information indicative of the user input to the mode button.

Example 9: The device of example 8, wherein the processing circuitry is further configured to: control the set of LEDs cease an illumination of a cooling set point mode indicator on the analog display in response to receiving the information indicative of the user input to the mode button; and control the set of LEDs to illuminate a heating set point mode indicator on the analog display in response to receiving the information indicative of the user input to the mode button.

Example 10: The device of any of examples 1-9, wherein the processing circuitry is configured to, if the heating set point mode is activated: deactivate the heating set point mode in response to receiving information indicative of a user input to a mode button; and activate the cooling set point mode in response to receiving the information indicative of the user input to the mode button.

Example 11: The device of example 10, wherein the processing circuitry is further configured to: control the set of LEDs to cease an illumination of a heating set point mode indicator on the analog display in response to receiving the information indicative of the user input to the mode button; and control the set of LEDs to illuminate a cooling set point mode indicator on the analog display in response to receiving the information indicative of the user input to the mode button.

Example 12: A method comprising: determining, by processing circuitry of a device for controlling a heating, ventilation, and air conditioning (HVAC) system within a building, whether one or both of a cooling set point mode and a heating set point mode is activated; causing, by the processing circuitry in response to determining whether one or both of the cooling set point mode and the heating set point mode is activated, a set point to change from a first set point value to a second set point value in response to receiving a first rotation input to a dial; and controlling, by the processing circuitry, a set of LEDs to transition from illuminating a first marker of a set of markers to illuminating a second marker of the set of markers, wherein the first marker corresponds to the first set point value and the second marker corresponds to the second set point value, and wherein the device includes an analog display including the set of markers.

Example 13: The method of example 12, further comprising: determining, by the processing circuitry, that the cooling set point mode is activated; and causing, by the processing circuitry in response to determining that the cooling set point mode is activated, a cooling set point to change from a first cooling set point value to a second cooling set point value in response to receiving the first rotation input to the dial, wherein the first marker corresponds to the first cooling set point value and the second marker corresponds to the second cooling set point value.

Example 14: The method of example 13, wherein the first cooling set point value is greater than a heating set point value, wherein the second cooling set point value is greater than or equal to the heating set point value, and wherein the method further comprises: causing, by the processing circuitry, the cooling set point to change from the first cooling set point value to the second cooling set point value without changing the heating set point value in response to receiving the first rotation input to the dial.

Example 15: The method of any of examples 12-14, further comprising: determining, by the processing circuitry, that the heating set point mode is activated; and causing, by the processing circuitry in response to determining that the heating set point mode is activated, a heating set point to change from a first heating set point value to a second heating set point value in response to receiving the first rotation input to the dial, wherein the first marker corresponds to the first heating set point value and the second marker corresponds to the second heating set point value.

Example 16: The method of example 15, wherein the first heating set point value is less than a cooling set point value, wherein the second heating set point value is less than or equal to the cooling set point value, and wherein the method further comprises: causing, by the processing circuitry, the heating set point to change from the first heating set point value to the second heating set point value without changing the cooling set point value in response to receiving the first rotation input to the dial.

Example 17: The method of any of examples 15-16, wherein the first heating set point value is lower than a first cooling set point value, wherein the second heating set point value is greater than the first cooling set point value, and wherein the method further comprises: causing, by the processing circuitry, the cooling set point to change from the first cooling set point value to a second cooling set point value in response to receiving the first rotation input to the dial, wherein the second cooling set point value is the same as the second heating set point value.

Example 18: The method of example 17, wherein the method further comprises: receiving a second rotation input to the dial; causing the heating set point to change from the second heating set point value to a third heating set point value in response to receiving the second rotation input to the dial, wherein the third heating set point value is lower than the first cooling set point value; and causing the cooling set point value to change from the second cooling set point value to the first cooling set point value in response to receiving the second rotation input to the dial.

Example 19: The method of any of examples 12-18, wherein the method further comprises, if the cooling set point mode is activated: deactivating the cooling set point mode in response to receiving information indicative of a user input to a mode button; and activating the heating set point mode in response to receiving the information indicative of the user input to the mode button.

Example 20: A device for controlling a heating, ventilation, and air conditioning (HVAC) system within a building, the device comprising: a dial; an analog display including a set of markers; and processing circuitry configured to: determine whether one or both of a cooling set point mode and a heating set point mode is activated; cause, in response to determining whether one or both of the cooling set point mode and the heating set point mode is activated, a set point to change from a first set point value to a second set point value in response to receiving a first rotation input to the dial; and control a set of LEDs to transition from illuminating a first marker of the set of markers to illuminating a second marker of the set of markers, wherein the first marker corresponds to the first set point value and the second marker corresponds to the second set point value.

Example 21: A device for controlling a heating, ventilation, and air conditioning (HVAC) system within a building, the device comprising: a rotatable dial; an analog display; and processing circuitry configured to: determine whether one or both of a first mode and a second mode is activated; cause, based on the first mode being activated, a first set point of the device to change in response to receiving a rotation input; and cause, based on the second mode being activated, a second set point of the device to change in response to receiving the rotation input.

Example 22: The device of example 21, wherein the device further comprises a mode button, and wherein the processing circuitry is configured to, if the first mode is activated: deactivate the first mode in response to receiving information indicative of a user input to the mode button; and activate the second mode in response to receiving the information indicative of the user input to the mode button.

Example 23: The device of example 22, wherein the processing circuitry is further configured to: output an instruction to cease an illumination of a first mode indicator on the analog display in response to receiving the information indicative of the user input to the mode button; output an instruction to illuminate a second mode indicator on the analog display in response to receiving the information indicative of the user input to the mode button.

Example 24: The device of any of examples 21-23, wherein the device further comprises a mode button, and wherein the processing circuitry is configured to, if the second mode is activated: deactivate the second mode in response to receiving information indicative of a user input to the mode button; and activate the first mode in response to receiving the information indicative of the user input to the mode button.

Example 25: The device of example 24, wherein the processing circuitry is further configured to: output an instruction to cease an illumination of a second mode indicator on the analog display in response to receiving the information indicative of the user input to the mode button; output an instruction to illuminate a first mode indicator on the analog display in response to receiving the information indicative of the user input to the mode button.

Example 26: The device of any of examples 21-25, wherein the first mode represents a cooling temperature set point mode, wherein the first set point represents a cooling temperature set point, wherein the second mode represents a heating temperature set point mode, and wherein the second set point represents a heating temperature set point.

Example 27: The device of any of examples 21-26, wherein the first set point is lower than the second set point, and wherein to cause the first set point to change, the processing circuitry is configured to: cause the first set point to change from a first set point value to a second set point value, wherein the second set point value is greater than an initial value of the second set point; and cause the second set point to change Example 28: The device of example 27, wherein the processing circuitry is further configured to: cause the first set point to change from the second set point value to a third set point value, wherein the third set point value is lower than the initial value of the second set point; and cause the second set point to change from the second set point value to the initial value of the second set point.

Example 29: The device of any of examples 21-28, wherein the first set point is lower than the second set point, and wherein to cause the second set point to change, the processing circuitry is configured to: cause the second set point to change from a first set point value to a second set point value, wherein the second set point value is lower than an initial value of the first set point; and cause the first set point to change from the initial value of the first set point to the second set point value.

Example 30: The device of example 29, wherein the processing circuitry is further configured to: cause the second set point to change from the second set point value to a third set point value, wherein the third set point value is greater than the initial value of the first set point; and cause the first set point to change from the second set point value to the initial value of the first set point.

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can include one or more of RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more DSPs, general purpose microprocessors, ASICs, FPGAs, or other equivalent integrated or discrete logic circuitry. Accordingly, the term "processor" or "processing circuitry," as used herein may refer to any of the foregoing structure or any other structure suitable for implementation of the techniques described herein. In addition, in some aspects, the functionality described herein may be provided within dedicated hardware and/or software modules. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a single hardware unit or provided by a collection of interoperative hardware units, including one or more processors as described above, in conjunction with suitable software and/or firmware.

Various examples have been described. These and other examples are within the scope of the following claims.

What is claimed is:

1. A device for controlling a heating, ventilation, and air conditioning (HVAC) system within a building, the device comprising:

an analog display including a set of markers; and processing circuitry configured to:

determine whether one of a cooling set point mode or a heating set point mode is activated;

cause, in response to determining whether one of the cooling set point mode or the heating set point mode is activated, a set point to change from a first set point value to a second set point value in response to receiving a first rotation input to a dial; and control a set of LEDs to transition from illuminating a first marker of the set of markers to illuminating a second marker of the set of markers, wherein the first marker corresponds to the first set point value and the second marker corresponds to the second set point value.

2. The device of claim 1, wherein the processing circuitry is configured to:

determine that the cooling set point mode is activated; and cause, in response to determining that the cooling set point mode is activated, a cooling set point to change from a first cooling set point value to a second cooling set point value in response to receiving the first rotation input to the dial, wherein the first marker corresponds to the first cooling set point value and the second marker corresponds to the second cooling set point value.

3. The device of claim 2, wherein the first cooling set point value is greater than a heating set point value, wherein the second cooling set point value is greater than or equal to the heating set point value, and wherein the processing circuitry is configured to:

cause the cooling set point to change from the first cooling set point value to the second cooling set point value without changing the heating set point value in response to receiving the first rotation input to the dial.

4. The device of claim 1, wherein the processing circuitry is configured to:

determine that the heating set point mode is activated; and cause, in response to determining that the heating set point mode is activated, a heating set point to change from a first heating set point value to a second heating set point value in response to receiving the first rotation input to the dial, wherein the first marker corresponds to the first heating set point value and the second marker corresponds to the second heating set point value.

5. The device of claim 4, wherein the first heating set point value is less than a cooling set point value, wherein the second heating set point value is less than or equal to the cooling set point value, and wherein the processing circuitry is configured to:

cause the heating set point to change from the first heating set point value to the second heating set point value without changing the cooling set point value in response to receiving the first rotation input to the dial.

6. The device of claim 4, wherein the first heating set point value is lower than a first cooling set point value, wherein the second heating set point value is greater than the first cooling set point value, and wherein the processing circuitry is configured to:

cause a cooling set point to change from the first cooling set point value to a second cooling set point value in response to receiving the first rotation input to the dial, wherein the second cooling set point value is the same as the second heating set point value.

7. The device of claim 6, wherein the processing circuitry is configured to:

receive a second rotation input to the dial;

cause the heating set point to change from the second heating set point value to a third heating set point value in response to receiving the second rotation input to the dial, wherein the third heating set point value is lower than the first cooling set point value; and cause a cooling set point value to change from the second cooling set point value to the first cooling set point value in response to receiving the second rotation input to the dial.

8. The device of claim 1, wherein the processing circuitry is configured to, if the cooling set point mode is activated:

deactivate the cooling set point mode in response to receiving information indicative of a user input to a mode button; and activate the heating set point mode in response to receiving the information indicative of the user input to the mode button.

9. The device of claim 8, wherein the processing circuitry is further configured to:

control the set of LEDs to cease an illumination of a cooling set point mode indicator on the analog display in response to receiving the information indicative of the user input to the mode button; and control the set of LEDs to illuminate a heating set point mode indicator on the analog display in response to receiving the information indicative of the user input to the mode button.

10. The device of claim 1, wherein the processing circuitry is configured to, if the heating set point mode is activated:

deactivate the heating set point mode in response to receiving information indicative of a user input to a mode button; and activate the cooling set point mode in response to receiving the information indicative of the user input to the mode button.

11. The device of claim 10, wherein the processing circuitry is further configured to:

control the set of LEDs to cease an illumination of a heating set point mode indicator on the analog display in response to receiving the information indicative of the user input to the mode button; and control the set of LEDs to illuminate a cooling set point mode indicator on the analog display in response to receiving the information indicative of the user input to the mode button.

12. A method comprising:

determining, by processing circuitry of a device for controlling a heating, ventilation, and air conditioning (HVAC) system within a building, whether one of a cooling set point mode or a heating set point mode is activated;

causing, by the processing circuitry in response to determining whether one of the cooling set point mode or the heating set point mode is activated, a set point to change from a first set point value to a second set point value in response to receiving a first rotation input to a dial; and controlling, by the processing circuitry, a set of LEDs to transition from illuminating a first marker of a set of markers to illuminating a second marker of the set of markers, wherein the first marker corresponds to the first set point value and the second marker corresponds to the second set point value, and wherein the device includes an analog display including the set of markers.

13. The method of claim 12, further comprising:

determining, by the processing circuitry, that the cooling set point mode is activated; and causing, by the processing circuitry in response to determining that the cooling set point mode is activated, a cooling set point to change from a first cooling set point value to a second cooling set point value in response to receiving the first rotation input to the dial, wherein the first marker corresponds to the first cooling set point value and the second marker corresponds to the second cooling set point value.

14. The method of claim 13, wherein the first cooling set point value is greater than a heating set point value, wherein the second cooling set point value is greater than or equal to the heating set point value, and wherein the method further comprises:

causing, by the processing circuitry, the cooling set point to change from the first cooling set point value to the second cooling set point value without changing the heating set point value in response to receiving the first rotation input to the dial.

15. The method of claim 12, further comprising:

determining, by the processing circuitry, that the heating set point mode is activated; and causing, by the processing circuitry in response to determining that the heating set point mode is activated, a heating set point to change from a first heating set point value to a second heating set point value in response to receiving the first rotation input to the dial, wherein the first marker corresponds to the first heating set point value and the second marker corresponds to the second heating set point value.

16. The method of claim 15, wherein the first heating set point value is less than a cooling set point value, wherein the second heating set point value is less than or equal to the cooling set point value, and wherein the method further comprises:

causing, by the processing circuitry, the heating set point to change from the first heating set point value to the second heating set point value without changing the cooling set point value in response to receiving the first rotation input to the dial.

17. The method of claim 15, wherein the first heating set point value is lower than a first cooling set point value, wherein the second heating set point value is greater than the first cooling set point value, and wherein the method further comprises:

causing, by the processing circuitry, a cooling set point to change from the first cooling set point value to a second cooling set point value in response to receiving the first rotation input to the dial, wherein the second cooling set point value is the same as the second heating set point value.

18. The method of claim 17, wherein the method further comprises: receiving a second rotation input to the dial;

causing the heating set point to change from the second heating set point value to a third heating set point value in response to receiving the second rotation input to the dial, wherein the third heating set point value is lower than the first cooling set point value; and causing a cooling set point value to change from the second cooling set point value to the first cooling set point value in response to receiving the second rotation input to the dial.

19. The method of claim 12, wherein the method further comprises, if the cooling set point mode is activated:

deactivating the cooling set point mode in response to receiving information indicative of a user input to a mode button; and activating the heating set point mode in response to receiving the information indicative of the user input to the mode button.

20. A device for controlling a heating, ventilation, and air conditioning (HVAC) system within a building, the device comprising:

a dial;

an analog display including a set of markers; and processing circuitry configured to:

determine whether one of a cooling set point mode or a heating set point mode is activated;

cause, in response to determining whether one of the cooling set point mode or the heating set point mode is activated, a set point to change from a first set point value to a second set point value in response to receiving a first rotation input to the dial; and control a set of LEDs to transition from illuminating a first marker of the set of markers to illuminating a second marker of the set of markers, wherein the first marker corresponds to the first set point value and the second marker corresponds to the second set point value.

* * * * *